US012434284B2

(12) United States Patent
Nardella et al.

(10) Patent No.: US 12,434,284 B2
(45) Date of Patent: Oct. 7, 2025

(54) STEEL PRODUCT PROCESSING PLANT WITH SCALE SEPARATION AND RECOVERY SYSTEM

(71) Applicant: DANIELI & C. OFFICINE MECCANICHE S.P.A., Buttrio (IT)

(72) Inventors: Antonio Nardella, Greve in Chianti (IT); Nino Zanetti, Cavazzo Carnico (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 18/712,611

(22) PCT Filed: Nov. 22, 2022

(86) PCT No.: PCT/IB2022/061247
§ 371 (c)(1),
(2) Date: May 22, 2024

(87) PCT Pub. No.: WO2023/094976
PCT Pub. Date: Jun. 1, 2023

(65) Prior Publication Data

US 2025/0010345 A1 Jan. 9, 2025

(30) Foreign Application Priority Data

Nov. 23, 2021 (IT) ..... 102021000029639

(51) Int. Cl.
*B21B 1/46* (2006.01)
*B21B 1/22* (2006.01)
*B21B 45/02* (2006.01)

(52) U.S. Cl.
CPC ..... *B21B 1/463* (2013.01); *B21B 1/22* (2013.01); *B21B 45/0293* (2013.01); *B21B 2263/02* (2013.01)

(58) Field of Classification Search
CPC ..... B21B 1/463; B21B 1/22; B21B 45/0293; B21B 45/029; B21B 2263/02
See application file for complete search history.

(56) References Cited

U.S. PATENT DOCUMENTS 4,344,308 A * 8/1982 Shimada ..... B21B 45/0284 72/39
5,511,303 A * 4/1996 Tippins ..... B21B 45/00 72/202

(Continued)

FOREIGN PATENT DOCUMENTS

DE 10143407 A1 * 3/2003 ..... B21B 1/28
JP S62137112 A * 6/1987

(Continued)

OTHER PUBLICATIONS

Naito Tadashi et al.; JPS62137112A Roll Coolant Device; Jun. 20, 1987; EPO English Machine Translation; p. 1 (Year: 1987).*

(Continued)

*Primary Examiner* — Bayan Salone
(74) *Attorney, Agent, or Firm* — Tutunjian & Bitetto, P.C.

(57) ABSTRACT

The invention relates to a steel product processing plant, in particular including a rolling line and preferably upstream thereof a continuous casting line including at least one steel product direct cooling or cleaning system, or another system suitable to spray water on the product being processed; and a system for the separation of mixtures, in particular of a muddy nature, including water and scale deriving from said systems, which is provided with at least two pits (F1, F2) for collecting the mixtures, wherein at least a first pit (F1), advantageously provided with a dredging system for continuously removing the scale, is fed by water with coarse scale and at least a second pit (F2) with water with fine scale and wherein said pits each have a maximum overall depth <10 m, preferably even less.

10 Claims, 7 Drawing Sheets

(56) References Cited

U.S. PATENT DOCUMENTS

| | | | | | |
|---|---|---|---|---|---|
| 5,675,880 | A * | 10/1997 | Saikin | B21B 45/08 | 134/22.12 |
| 5,794,658 | A * | 8/1998 | Saikin | B21B 45/08 | 251/118 |
| 2005/0011243 | A1 * | 1/2005 | Bunten | B21B 45/029 | 72/42 |

FOREIGN PATENT DOCUMENTS

| | | | | |
|---|---|---|---|---|
| KR | 20020044838 | A * | 6/2002 | |
| WO | WO-9208557 | A1 * | 5/1992 | B21B 1/463 |

OTHER PUBLICATIONS

International Search Report for corresponding Application No. PCT/IB2022/061247 dated Feb. 9, 2023, 5 pgs.

Reitemeyer et al., "New High-Capacity Scale Separation for Cooling Water Recycling At Badische Stahlwerke", vol. 125, No. 10, Oct. 17, 2005, pp. 39-44.

Mori et al., "Development of Management On-Line Analyzers For Cold Rolling Oil", Tetsu to Hagane: Journal of the Iron and Steel Institute of Japan, Iron and Steel Institute of Japan, vol. 79, No. 7, Jan. 1, 1993, pp. 890-895.

* cited by examiner

FIG.5
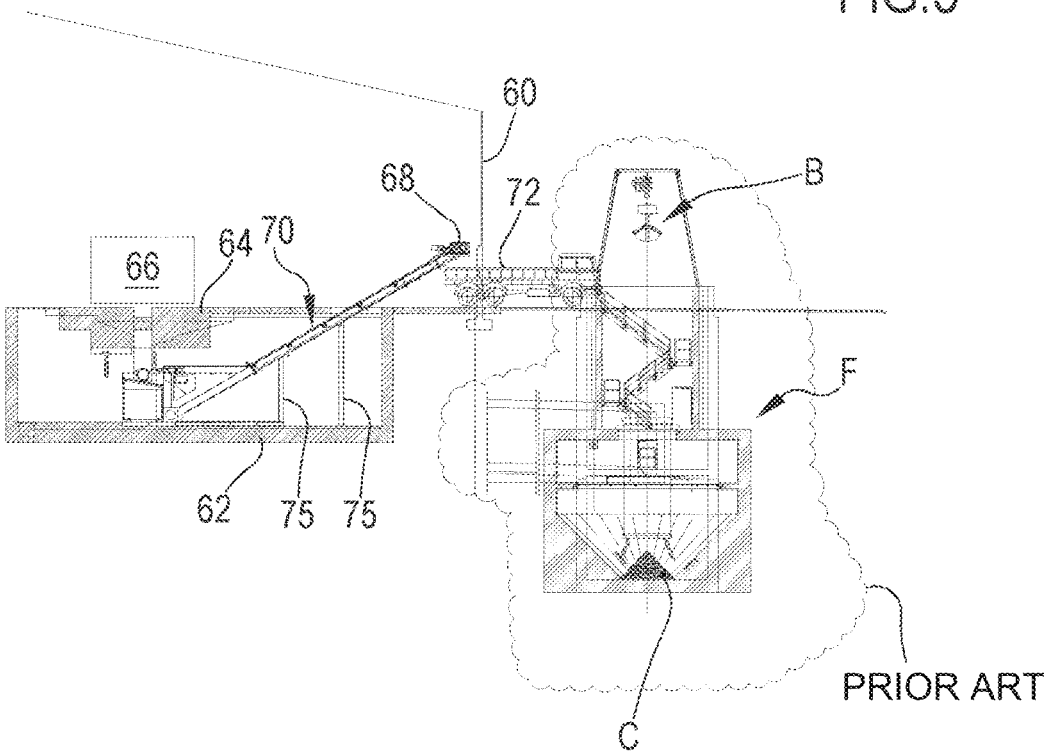
FIG.6a
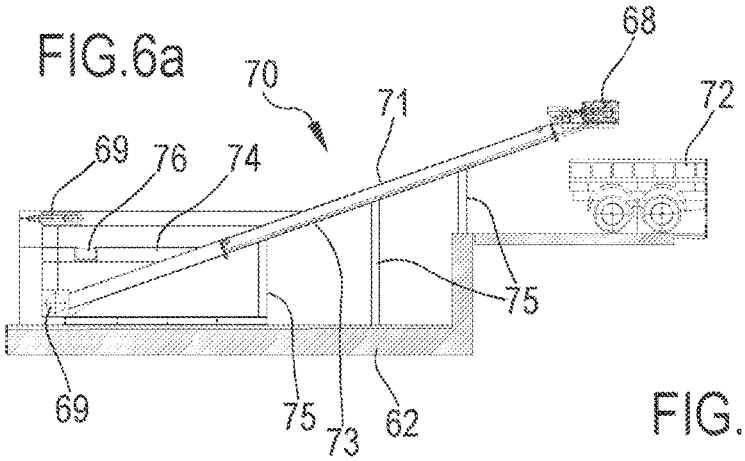
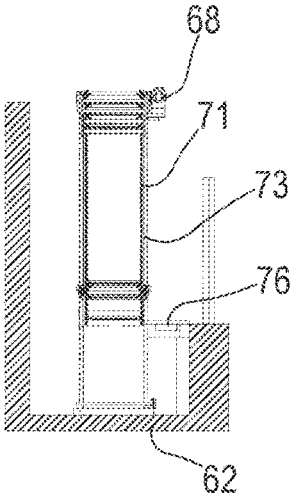
FIG.6c
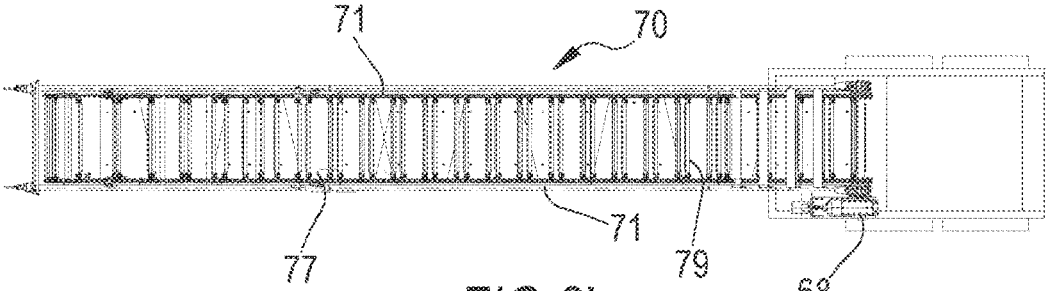
FIG.6b

FIG.7a
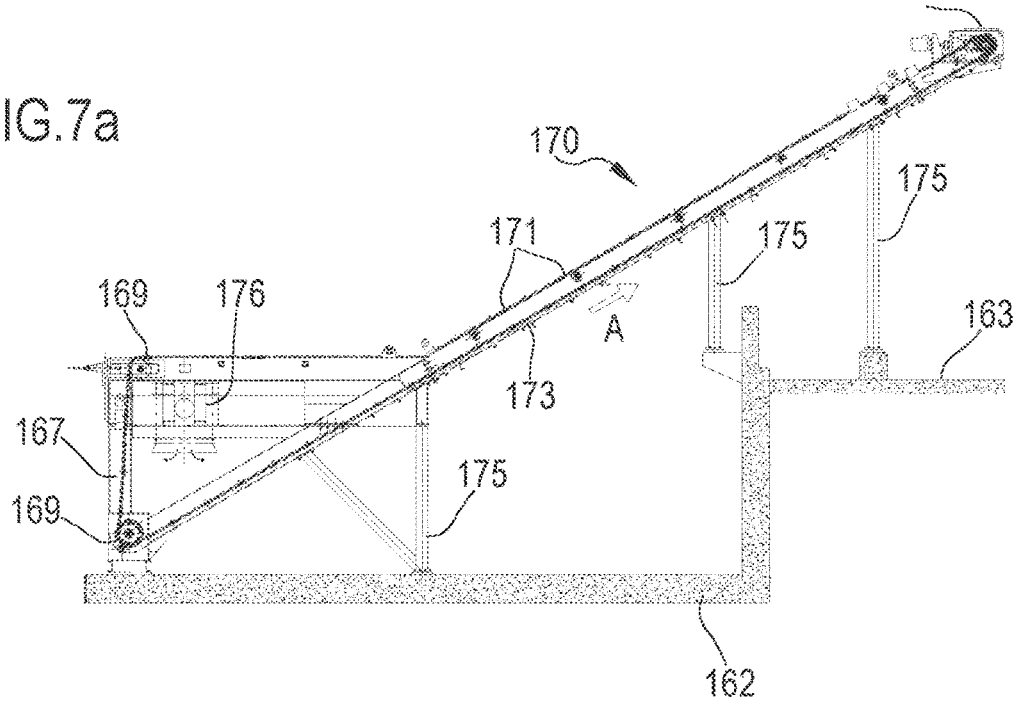
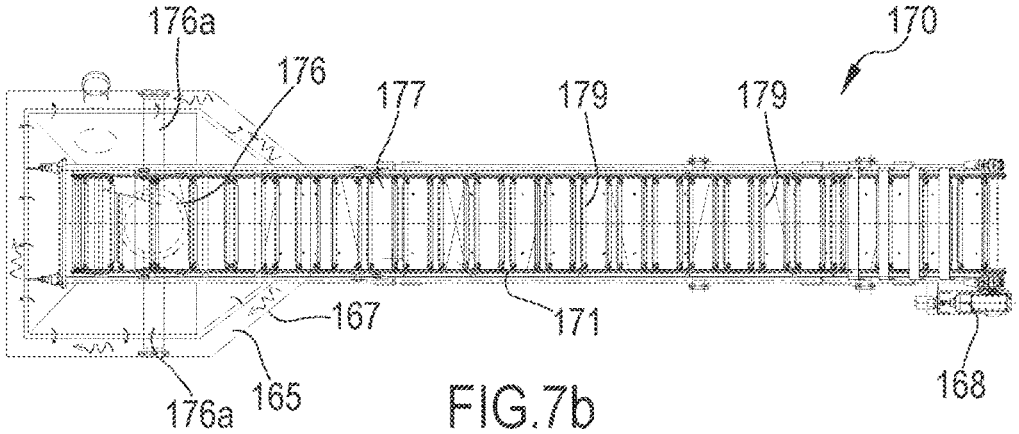
FIG.7b
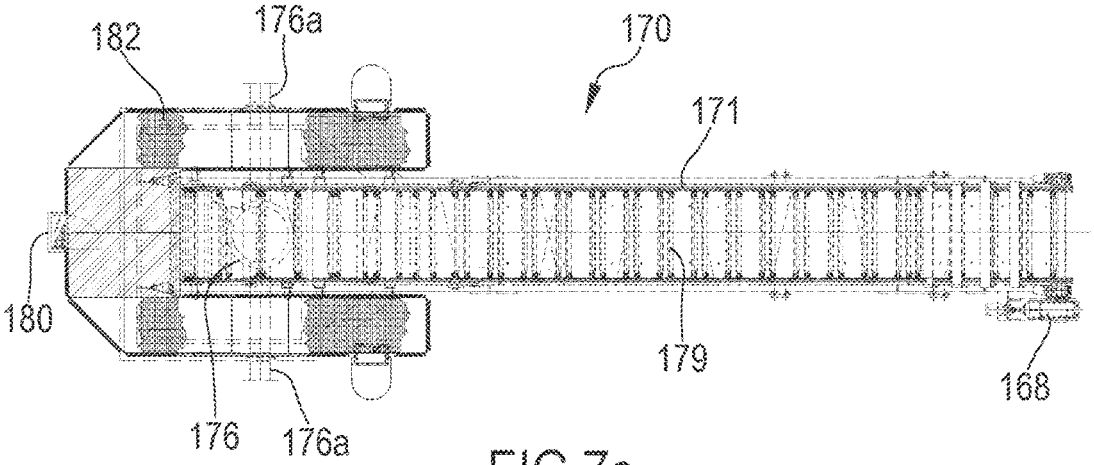
FIG.7c

STEEL PRODUCT PROCESSING PLANT WITH SCALE SEPARATION AND RECOVERY SYSTEM

TECHNICAL FIELD

The present invention relates to a steel product processing plant, in particular comprising at least one rolling mill provided with a plurality of stands arranged in series and adapted to progressively reduce the thickness of the product to be rolled in the advancement direction, and optionally a descaling machine and a continuous casting line arranged upstream of said rolling mill and of said descaling machine. Said plant, in particular said lines are further provided with:

(a) at least one steel product direct cooling or cleaning system, or other system adapted to spray water on the product being processed; and (b) at least one system for separating mixtures, in particular mixtures of a muddy nature, comprising at least water and scale, deriving from said at least one steel product direct cooling or cleaning system, or said other system adapted to spray water on the product being processed.

Steel product cleaning systems are, for example, water jet descaling machines.

BACKGROUND ART

The steel product processing process includes several steps in which the product is at a high temperature, for example during casting and subsequent rolling. This metal in contact with the environment undergoes an oxidation process which causes the formation of scale, a generic name with which iron oxide compounds are identified in the sector which compromise the quality aspect of the product if they are rolled (so-called rolled-in scale), and which lead to a decrease in the weight of the finished product. Therefore, in the production of hot rolled articles it is necessary to remove such scale from the metal surface in some specific steps, for example before or during the rolling. Descaling machines are used for this purpose, which generally remove the scale with high pressure water jets on the metal surface, possibly with the aid of mechanical devices. A descaling machine is generally formed by one or more spraying bars with nozzles which send the pressurized water jets across the material, so as to cause the detachment of the scale. The scale resulting from the rolling and continuous casting processes is also removed in the product cooling steps by direct cooling, by means of which a set of nozzles spray water and/or air on the metal product so as to decrease the temperature thereof (for example in the secondary cooling step of casting, or between the rolling stands). It is evident that this type of process employs considerable amounts of water (in a plant for long products, for example, it employs over 1,000 $m^3/h$, while a plant for flat products easily comes to use 10 times as much), which is mixed with clumps of scale possibly dirty with lubricating oil. To collect the mixtures of water and scale which are formed during the product processing steps, deep scale pits are currently created, which in addition to the collection of this mixed sludge, allow the subsequent process of separation from the water of the coarse, heavy scale by decanting or sedimentation by gravity and the return of the water, still however containing the fine and light scale, to the water treatment plant (WTP) of the plant.

The muddy waters are then all conveyed together to the so-called scale pit, in which the extraction of the sedimented coarse, heavy scale is performed by means of, for example, automatic buckets.

To allow the separation of the coarse/heavy scale, the scale pit is sized to have a hydraulic load equal to ~20 $m^3/m^2/h$. The scale pit which collects all the water from the direct descaling/cooling circuit requires high depths. In this regard, there is a need to have basins or tanks made, usually circular with a very deep inverted conical trunk bottom, typically 12-15 metres deep with respect to the ground floor 0 on which the steel plant stands. Very high investments are incurred to make such scale pits: civil works costs, long construction times, construction site problems (piling, dewatering, interference, extension of the construction sites, etc.), maintenance, installation of machines, etc. Furthermore, this sludge recovery and separation system is not selective, thus several steps are necessary to properly separate water and scale.

JP S62 137112 A describes the collection of muddy water in a single pit, while Reitmeyer and Diem (Reitmeyer, D. et al., "*Neue Hochleistungs-Zunderseparation im Kühlwasser-Recycling bei den Badischen Stahlwerken/New High-Capacity Scale Separation for Cooling Water Recycling at Badische Stahlwerke*", Stahl und Eisen vol. 125, n. 10, 2005, 39-44) describe a subdivision of the muddy water flows of a rolling mill according to the size of the scale in order to consider the needs of the subsequent separation in hydrocyclones.

SUMMARY OF THE INVENTION

The object of the invention is to overcome the aforesaid drawbacks and to propose a steel product processing plant with steel product direct cooling or cleaning systems and a sludge mixture separation system comprising at least water and sludge deriving from the direct cooling and/or cleaning, which reduces the expense of civil works, which is applicable to various configurations of rolling and/or continuous casting plants and which is simple to maintain. Another object of the invention is to provide a relative separation process of mixtures comprising at least water and scale deriving from the above cleaning and/or direct cooling. Further objects or advantages of the invention will become apparent from the following disclosure.

In a first aspect of the invention, the object is achieved by a steel product processing plant according to the first claim and as defined above in which the separation system comprises:

(b-1) at least a first collection pit of the mixtures;

(b-2) at least a second collection pit of the mixtures;

wherein the pits each have an overall depth <10 m, preferably <8 m, even more preferably <6.50 m, and wherein said at least a first pit is fed with mixtures deriving from the casting or from said descaling machine and/or from one or more initial stands of the rolling mill and wherein said at least a second pit is fed by one or more groups formed by the remaining stands of the rolling mill.

If the pits are placed below ground level, their depth essentially corresponds to the excavation depth necessary to receive them starting from ground level.

In a preferred embodiment of the invention, each pit comprises:

(i) a channel or a channel system, (ii) at least one collection tank of the mixtures into which said channel or said channel system opens.

The overall depth is to be understood as the sum of the depth of the channel or the channel system and the tank, or as the excavation depth necessary to receive the set of elements listed. In the case of the first pit, the channel can have, for example, a depth of 3.50 m and the tank of 2.50 m, resulting in a total pit depth of 6.00 m, while in the case of the second pit the channel has a depth of 3.50 m and the relative tank of 3 m, resulting in a total depth of 6.50 m. If portions of the channel or channel system and the related collection tank are at least partially on the same level, the overall depth is understood as the sum of the depth of the channel/channel system and the depth of the tank minus the depth of the portions on the same level.

The division of the sole classic pit into two or more distinct pits has made it possible to reduce their overall depth since the mixtures can be divided between all these pits.

The rolling stands comprise relative direct cooling systems. The mixtures deriving from the casting, from the descaling machine and/or from the direct cooling of the rolling mill are therefore divided into at least two flows, a first deriving advantageously from the secondary cooling of the casting, the descaling machine and the first stands of the rolling mill, all components which generally produce large, heavy scale, separable by means of the dredging device, and a second flow deriving from subsequent stands which gradually produce increasingly fine scale, which is small and light; the second flow can be pumped from the relative collection tank of the mixtures directly to a longitudinal clarifier, while in the prior art all the mixtures of the entire plant were conveyed together in a single pit and it was then necessary to separate the heavy, large scale from the entire volume of the collected mixtures, while in the invention it is sufficient to carry out this separation only for a portion of the mixtures, and precisely from the first flow. Both systems, classic and new, can have a hydraulic load equal to 20 $m^3/m^2/h$.

Preferably, the channels or channel systems of the pits do not exceed 4 m in depth.

In a very advantageous embodiment of the invention, the first pit comprises a dredging device, in particular a mechanical scraping conveyor. Advantageously, the dredging device is arranged in the tank and the mixture, in particular coming from casting and first part of the rolling mill, comprising at least water and large-size scale collected from the channel or channel system of the first pit, is directed directly to the dredging device. Preferably, as mentioned, the dredging device is a scraping conveyor which comprises along its longitudinal extension a channel with wear-resistant plates within which run, guided by relative rollers of which at least one motorized, in relative circuits, two parallel chains between which scraping blades (scraping beams) are transversely fixed parallel to each other so that they are capable of scraping the mixtures, i.e., the sludge of water and coarse scale along said channel plates, accumulating it and advancing the decanted scale in the conveyor channel. Advantageously, near the entrance of the mixtures into the tank, located above the conveyor, the chains of the same circuit are further spaced apart from each other by a further sending roller. Alternatively, belt dredging systems with a series of buckets can be used which are adapted to collect and transport the scale accumulated on the bottom of the tank.

With such a dredging device, in particular a scraping conveyor, the scale is continuously and automatically removed, and it is thus not necessary to periodically perform removals with the bucket.

The invention is particularly applicable to hot rolling mills for long products, fast finishing blocks (FFB), minimills, heavy products (HSeM, Heavy Section Mill) and systems consisting of continuous casting and rolling in general, but is also designable for rolling mills and casting machines for flat products adapted for the production of strips (Hot Strip Mills, HSM).

In an embodiment of the invention it is included that the first pit has inclined side walls, in particular with an inclination between 45 and 75°, preferably between 55 and 65°, more preferably about 60°. With an inclination of 60° and the same dredging system, it is possible to double the decantation surface with respect to 90° walls.

Preferably, the channel or the channel system comprises a distribution hood which forms the entrance into said at least one collection tank of the mixtures of the first pit. This thus avoids preferential routes with the accumulation of scale in difficult areas, hindering the correct dredging process. For example, the hood is positioned in the centre of the tank.

In a preferred embodiment of the invention, said at least one tank for collecting the mixtures of said first pit is provided in the upper edge along the perimeter, preferably along the entire perimeter, with a plurality of clarified water overflow channels which feed a further clarified water collection tank included for such a purpose in said first pit, preferably next to said first collection tank of the mixtures of water and scale. This expedient helps to avoid preferential routes with possible leakage of suspended solids into the clarified water.

These expedients make it possible to increase the processable flow rate of the dredging system, for example from 250 $m^3/h$ to 500 $m^3/h$ for rolling mills and from 300 $m^3/h$ to 600 $m^3/h$ for continuous casting machines.

Further embodiments of the invention, described below, ensure, by virtue of the elimination of sections which can cause difficulties during use, better management and maintenance.

In this regard, the plant according to the invention further comprises an emergency tank, preferably arranged on the side of said at least one collection tank of the mixtures of said first pit, or on the side of the dredging device. Preferably, the emergency tank is made of reinforced concrete. The emergency tank allows to remove a tank with an emergency basket on the entrance of the dredging device. This avoids the problems of removing the lid with water and scale which continues to arrive and the difficulties of reinserting the emergency basket due to the residual scale in the tank, etc. For example, the emergency tank is capable of collecting scale for a work day, thus allowing special maintenance that may be required by the equipment. Furthermore, advantageously, the entrance to said at least one collection tank of the mixtures of said first pit is made, preferably as a closed pipe, with an emergency by-pass adapted to feed said emergency tank. The use of a closed pipe instead of an open channel and a lid on an emergency basket avoids splashes of water and scale with consequent dirt and accumulations of scale.

With respect to a clarified water collection tank under the mixture collection tank and therefore under the dredging device, a tank, preferably in reinforced concrete, can be included at the side of the mixture collection tank. This facilitates periodic cleaning, no longer necessary in a confined and narrow space.

In a particularly preferred embodiment of the invention, the pits are at least partially arranged below said at least one steel product direct cooling or cleaning system, or of said other system adapted to spray water on the product being processed. In particular, it is advantageous to include the channel or channel system at least partially below these systems. The tanks themselves, as part of the channel or channel system, can be located to the side of said systems, but advantageously always below ground and lower than the channel or channel system. The reduced depth of the pits, preferably between 5 and 7 m, makes it possible to advantageously locate them inside the factory building which houses the steel product processing plant and not outside the factory building, as often envisaged by the state of the art.

A second aspect of the invention relates to a process for separating mixtures comprising water and scale deriving from a direct cooling and/or descaling of steel products comprising the following steps:

(I) producing metal scale in an oxidation process of a steel product in continuous casting and/or rolling processes;

(II) water jet descaling and/or direct cooling of the continuous casting and/or rolling product resulting in scale accumulation in the descaling and/or cooling water forming said mixtures comprising water and scale;

(III) conveying the mixtures with large size scale, in at least a first pit with an overall depth of less than 10 m and preferably provided with a dredging device, such as a scraping conveyor, and removing the large size scale, in particular >500 μm with said dredging device in a special container and diverting the clarified water, in particular through overflow elements present in said first pit;

(IV) conveying the mixtures with scale of fine particle size, in particular ≤500 μm, into at least a second pit with a depth less than 10 m and preferably removing the mixtures with pumps, without separation of the scale from the water, from the second pit.

The water and scale mixtures described in the disclosure of the invention are mixtures comprising water and scale, thus they contain at least water and scale, but can contain other components, such as lubrication oils or greases.

Another aspect of the invention includes that the steel product processing plant also comprises only a continuous casting machine with unloading of the casting products directly in a downstream plate, this machine being provided with direct cooling, wherein the separation unit comprises only a pit with depth <10 m, with a water/scale mixture collection tank with a dredging device and an overflow system for separating the clarified water.

The features and advantages disclosed for one aspect of the invention may be transferred mutatis mutandis to other aspects of the invention.

The industrial applicability is obvious from the moment wherein it is possible, with the same good results in the water's purification from scale, a considerable saving of CAPEX (abbreviation of CAPital EXpenditure). The subdivision of the flows, grouping on one side the mixtures with coarse scale, for example from casting, from the descaling machine and from the first flattening stands, and on the other side the remaining water containing gradually finer scale, allows to have to separate the coarse scale only from a portion of the dirty water and allows to pump and pass the water with finer scale through pipes. In fact, the rapid sedimentation of large, heavy scale is envisaged in the first pit along with its extraction, dredging and unloading in a dedicated container, perhaps directly on a truck or a transport vehicle. The overflow water from the tank of the first pit can be pumped into the water treatment plant for final purification, for example in a longitudinal clarifier, where medium particles are removed by sedimentation and oil and grease by an oil skimmer. The second flow can instead be collected in a rather small tank (or several tanks), of circular shape, for example, used to avoid the deposit of materials and with submerged pumps which remove the collected mixtures to the water treatment plant. This avoids the unwanted deposit of scale, and in any case, for any inconvenience, the pumping stations can wash the partially cleaned water in the channel during the re-stranding/maintenance steps. The scale coming from a continuous casting machine can be grouped in the scale of the first flow mentioned above (i.e., deriving from the first stands of a rolling mill), indeed the scale is even heavier, especially in the straightening section of the products, and the aforesaid system can be adopted, in particular the pit with dredging, but since the water is almost free of oil (normally used in rolling), it can be sent directly after the separation of the scale to the collection tank of the clarifier overflow for the final filtration.

The key concept of plant waste water treatment is to have a plurality of water recovery pits from the direct cooling of a rolling mill, which are less deep with respect to the background art, which envisages only one very deep pit with great expense in plant/construction terms.

The division into several pits is carried out starting in particular from the assumption that during the rolling, following the heating in the furnace, the oxide which is created on the product, also known as scale, decreases in size and quantity as the rolling continues. This means that in the early steps there is a high production of oxidation scale, which is very small towards the end. Therefore, the inventors consider it inadvisable to mix the dirty water with this type of scale size and treat it all together to clean it, but recommend dividing the water according to the different scale sizes and such as to be able to treat them specifically, creating simpler and less expensive plants.

Said objects and advantages will be further highlighted in the disclosure of preferred examples of embodiments of the invention given by way of non-limiting example.

Variant and further features of the invention are the subject matter of the dependent claims. The description of preferred embodiment examples of the plant and of the process according to the invention is given, by way of example and not of limitation, with reference to the attached drawings. In particular, unless otherwise specified, the number, shape, size and materials of the plant and of the individual components may vary, and equivalent elements may be applied without deviating from the inventive concept.

BRIEF DESCRIPTION OF THE DRAWINGS

FIG. 5 depicts in section a scale separation system according to the invention in comparison with a scale separation system according to the state of the art.

FIGS. 6 *a-c* depict in different views an embodiment example of a collection tank of water with scale with a scraping conveyor according to the invention.

FIGS. 7*a-d* depict in various more detailed views a scraping conveyor in a dirty water collection tank according to the invention.

DETAILED DESCRIPTION

Figure 1:
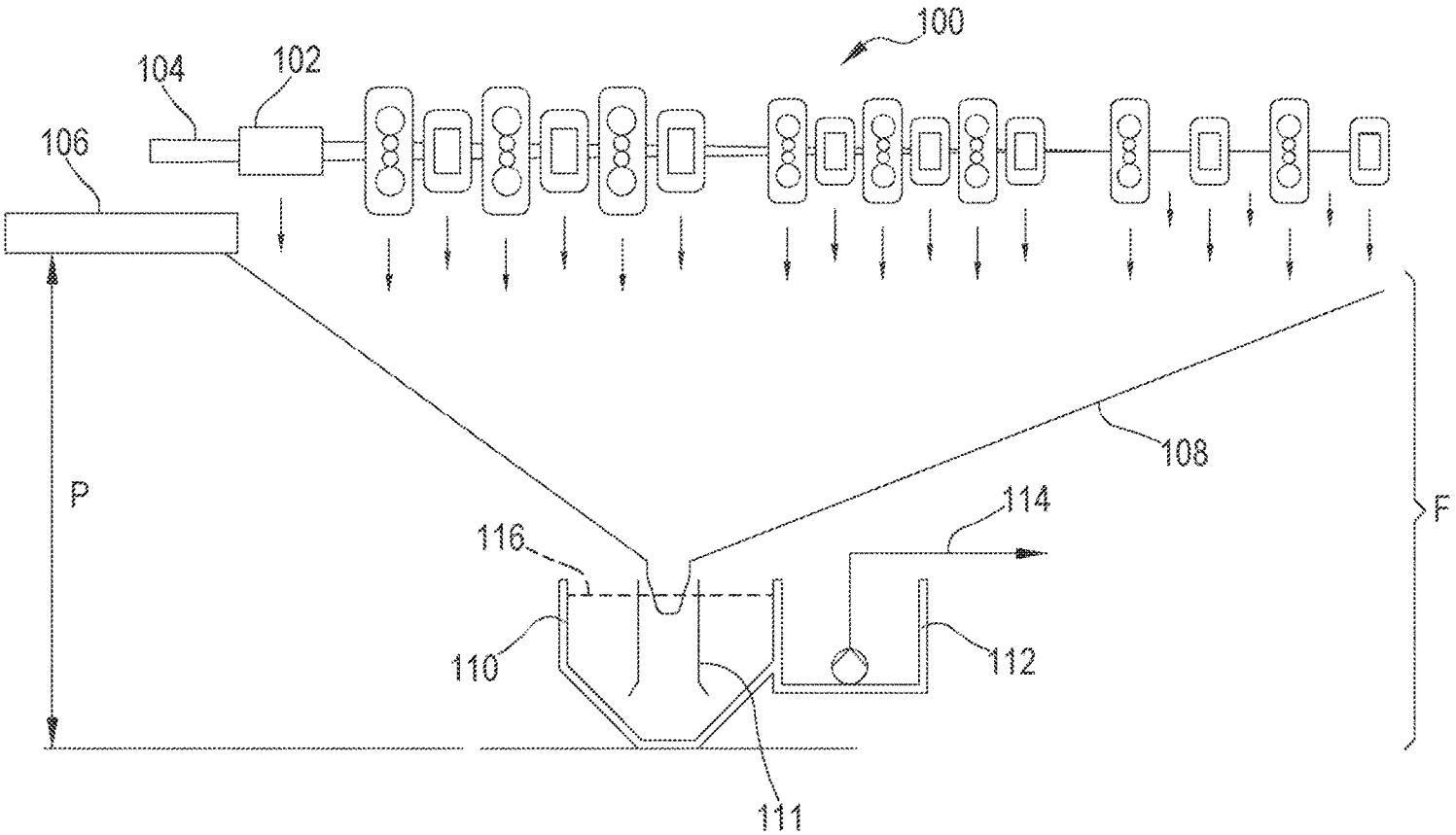
FIG.1 PRIOR ART
FIG. 1 depicts a principle scheme of scale separation in a rolling mill according to the state of the art.

FIG. 1 depicts a principle scheme of the system for collecting and separating the scale in a rolling mill according to the state of the art. A rolling mill 100 is preferably preceded by a descaling machine 102. A metal product 104 passes through the descaling machine 102 and into the rolling mill 100 to be rolled. The direct cooling water flows (arrows) from the descaling machine 102 and the rolling mill 100 (but possibly also from the secondary cooling of a casting arranged upstream, not shown) are collected in a channel 108, for example which reaches the yield end point at a depth of 9 m, and subsequently feed a scale pit/collection tank 110 through a distribution hood 111. The collection tank 110 can typically be located outside the factory building. When the water level 116 has reached the overflow of the tank 110, the clarified water (the bulk of the scale (not shown) due to its weight tends to sediment on the bottom of the tank 110) overflows and pours into the tank 112 for collecting the clarified water, from where it is conveyed by means of a pumping station 114 to further treatments, for example to a longitudinal clarifier (not shown). The tank 112 is preferably circular, with a diameter for example of 9 m. The overall depth P (channel 108+tank 110=pit F) is approximately 14 m and is located below the ground 106.

Figure 2:
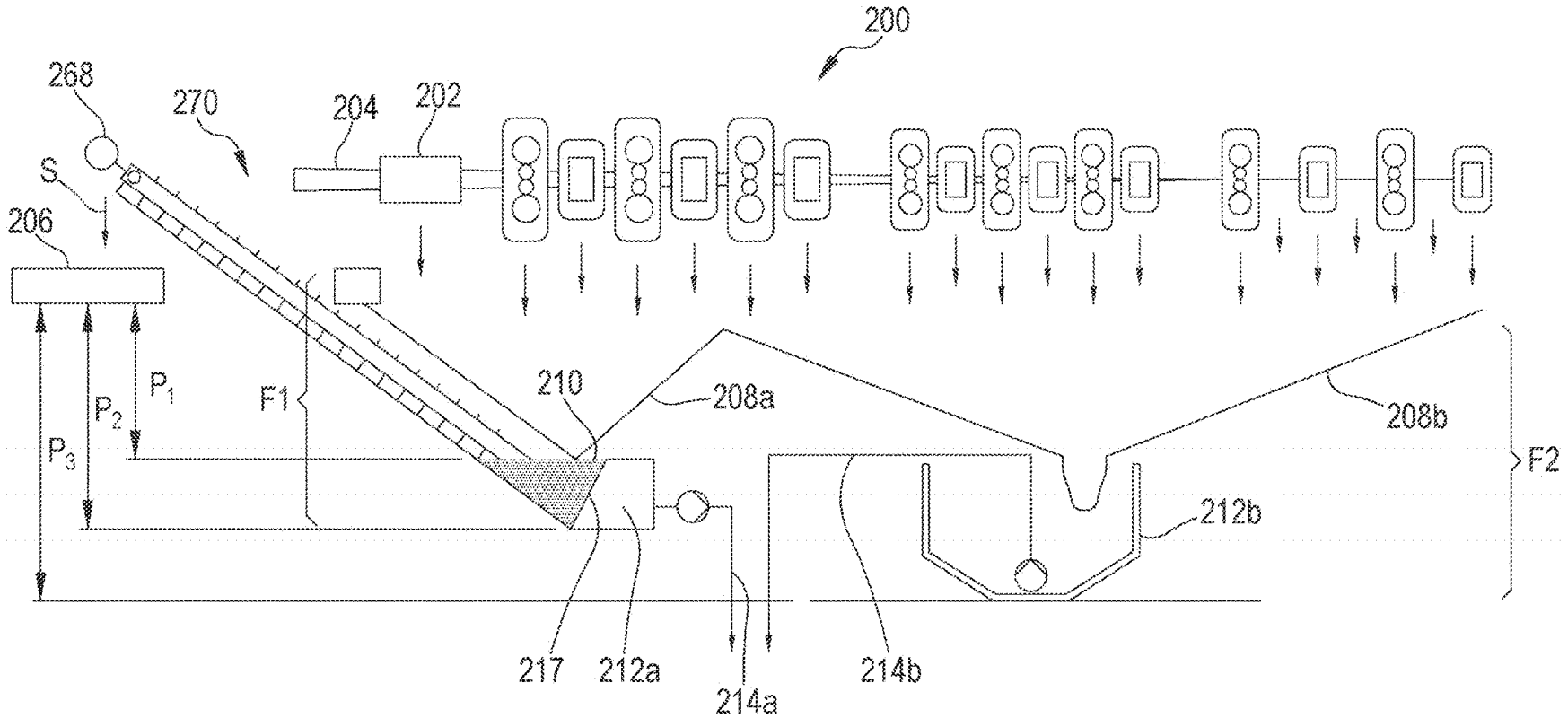
FIG. 2 depicts a principle scheme of the scale separation in a rolling mill according to the invention.

FIG. 2 depicts a principle scheme of the scale separation in a rolling mill according to the invention. Here, too, there is a rolling mill 200 preceded by a descaling machine 202, and possibly a continuous casting machine (not shown), through which a metal product 204 advances, decreasing in width/thickness. A first channel 208*a* and a second channel 208*b* are provided below the metal product processing line. The first channel 208*a* collects the water with scale from the descaling machine 202, from the casting secondary, if any, and from the first stands of the rolling mill 200, for example flattening stands; the second channel 208*b* collects the direct cooling water from the remaining stands of the rolling mill 200 and from any downstream quenching systems (not shown). From the first channel 208*a*, the waters with heavy scale reach a collection tank 210 in which a scraping conveyor 270, or dredge, is placed, driven by means 268 which remove the sedimented scale 217 and drop it (arrow S) into a special container for evacuation (not shown). The overflow water reaches a clarified water collection tank 212*a* from where it is pumped through a pumping station 214*a* towards a longitudinal clarifier (not shown). The waters collected by the second channel 208*b* and comprising lighter scale are instead fed to a collection tank 212*b* of water with scale from which the water is directly pumped by means of a relative pumping station 214*b* to the longitudinal clarifier (not shown). Seen from the ground, in an exemplary manner, the depth $P_1$ is about 3.35 m, the depth $P_2$ about 5.70 m and the depth $P_3$, which corresponds to the overall depth of the pit system, about 6.30 m. The collection tank 212*b* is preferably circular and has a diameter for example of 5 m. The channel 208*a* and the tank 210, with the tank 212*a*, form the first pit F1, and the channel 208*b* and the tank 212*b* form the second pit F2.

Figure 3:
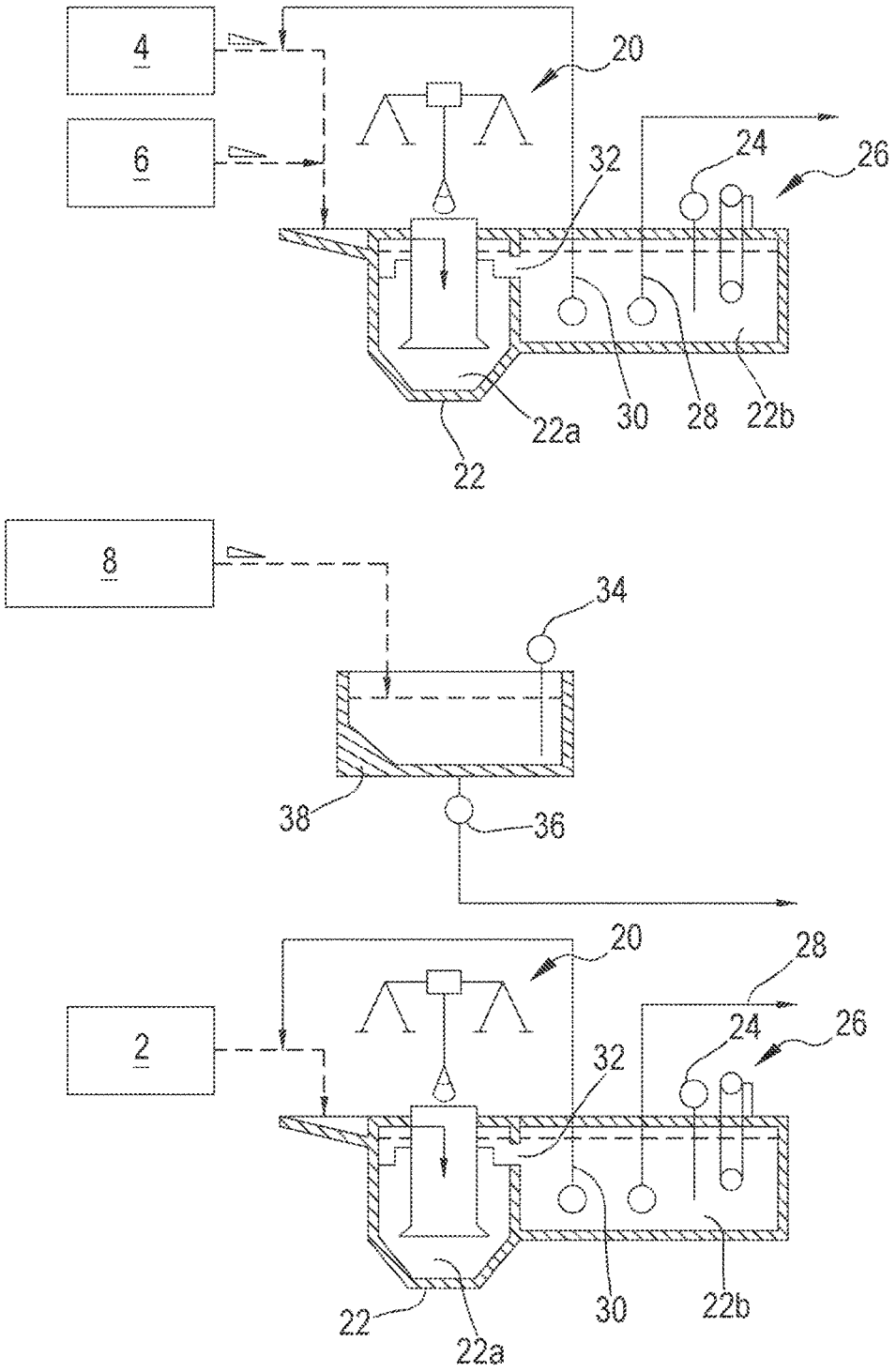
FIG.3 PRIOR ART
FIG. 3 depicts means for separating the scale in a steel product processing plant according to the state of the art.

FIG. 3 depicts the separation of scale in a steel product processing plant according to the state of the art. From various metal processing plants 4, 6, such as cooling systems of continuous casting machines, 2, 8, such as descaling units, rolling mills, direct cooling and quenching systems, etc., not only does water emerge dirty with oils and greases due to the lubrication of components such as the rolling rollers, but also as seen of scale detached following the handling of the product and its processing. The dirty water is directed to scale pits/pretreatment tanks 22 normally divided into two chambers 22*a* and 22*b* separated by an overflow 32. A level gauge 24 detects the water level in the tank 22. In the first chamber 22*a* the largest scale falls by gravity, with can be withdrawn with a relative magnetic crane or bucket 20. Normal maintenance activities must be carried out for the crane bucket and hoist 20. If the scale extraction bucket/hoist fails, the volume of the scale pit allows an accumulation of scale for 2-3 days to allow repairs to be performed without stopping the water purification plant.

In the second chamber 22*b*, an oil skimmer 26 removes the oil from the surface. First pumping means 30 withdraw the water to perform the washing of the water and scale transport channels and reintroduce it to a new treatment in the first chamber 22*a*. Second pumping means 28 withdraw the water to feed a longitudinal sedimentation tank (not shown) and subsequent sand filters. From the hardening and tempering plants of bars or rods 8, or from the cooling for strips, the dirty water with fine scale is instead directed to a recovery tank 38, provided with a water level meter 34 where the fine scale remains in suspension and the water is pumped with a pumping system 36 to further filtration treatments (not shown).

Figure 4:
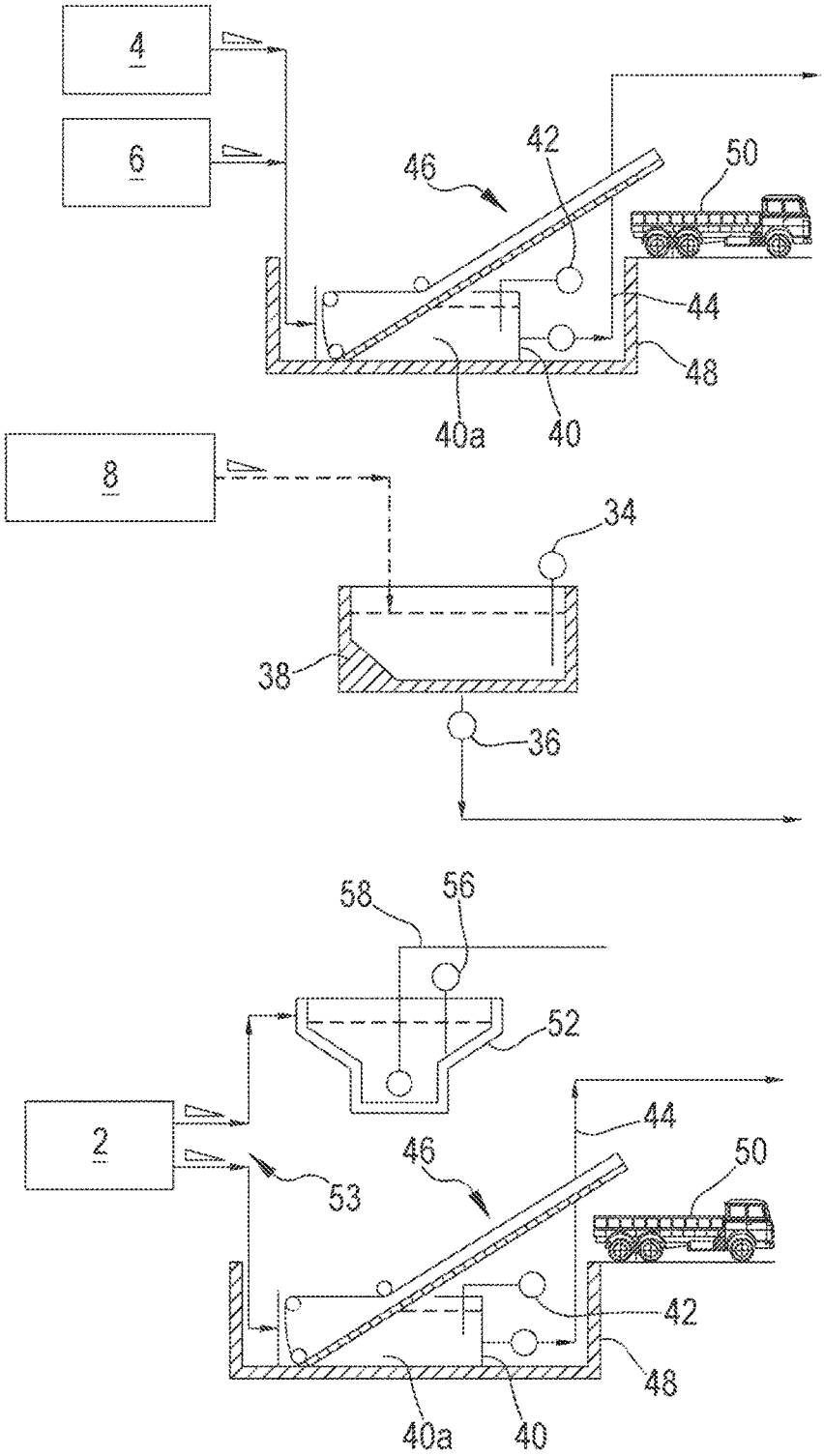
FIG. 4 depicts means for separating the scale in a steel product processing plant according to the invention.

FIG. 4 depicts the scale separation in a steel product processing plant according to the invention. From different product processing areas, such as a continuous casting machine 4, 6 provided with secondary cooling or a rolling mill 2 with possible descaling system, cooling and descaling waters emerge, in particular dirty water with scale from the product processing steps, which is directed to a collection tank 40 in which there is a dredging system 46 adapted to convey the scale directly to a container or removal means 50. The part 40*a* of the tank is separated, comprises a level gauge 42 and collects the clarified water which is pumped with a relative pumping system 44 to further treatments (not shown). The tank 40 is contained in a larger basin 48 which can comprise further tanks, for example an emergency tank (not shown). For the treatment of dirty water from hardening, treatment and tempering plants of bars or rods 8, characterized by a limited presence of small-sized scale, nothing changes with respect to the state of the art illustrated with reference to FIG. 3. The dirty water from the casting, descaling machine, and rolling mill 2, instead incorporating larger-sized scale, is divided into two flows 53 (based on the dimensional composition of the scale, as illustrated above with reference to FIG. 2) of which the first is directed to a dredging plant as described above for the water from the plants 4 and 6, while the second reaches a collection tank 52 with a level meter 56 and a pumping system 58 for pumping the water with fine scale to further purification treatments (not shown).

FIG. 5 depicts in section a scale separation system according to the invention in comparison with a scale separation system according to the state of the art. The collection tank 62 of the dirty water can be seen on the left, located below a rolling plant 66 inside a factory building 60. A scraping conveyor 70 supported by poles 75 and driven by a motor 68 removes the sedimented scale, separating it from the dirty water coming from the rolling mill 66 and entering through the channel 64 in the tank 62. The conveyor 70 fills a scale evacuation container or means 72. The cloud on the right in FIG. 5 instead depicts the principle according to the state of the art in which there is a single, very deep pit F outside the factory building 60 and in which a device with a hoist and bucket B is used for the periodic extraction of the scale C accumulated in the pit F.

FIGS. 6 *a-c* depict in different views an embodiment example of a collection tank of water with scale with a scraping conveyor according to the invention. FIG. 6*a* is a side sectional view of a tank 62 for collecting coarse scale dirty water with a dredging system 70 in the form of a scraping conveyor. The supports 75 support a channel 73 on which the scale falls from an inlet 76 along the water level 74, and where a chain system 71 with scraping blades moved by a motor 68 and guided around two sending rollers 69 drags the scale into a container or means 72 for the evacuation of the collected scale. FIG. 6*b* shows the conveyor 70 with the drive motor 68 from above. Scraping blades 79 are arranged between two parallel chains 71, which scrape along the plates 77 resistant to the wear of the channel and accumulate and transport the scale. Lastly, FIG. 6*c* is a cross-sectional view which clearly highlights the inlet 76 which feeds the conveyor 70 and the tank 62 through a channel or a closed pipe.

Figure 7D:
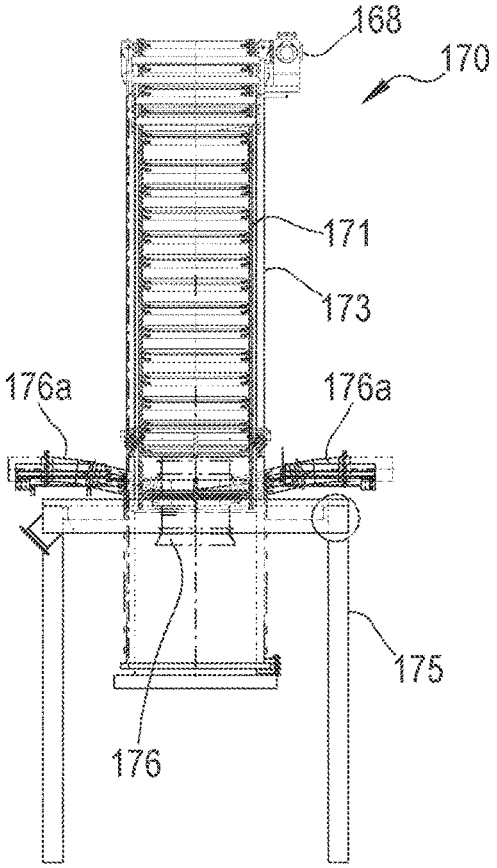

FIGS. 7*a-d* depict different views of a scraping conveyor 170 usable in the invention and arranged in a containment tank 162 below the ground 163. The supports 175 support a channel 173 on which water with coarse scale portions enters from the inlet 176 in the form of a distribution hood. The scale sediments on the channel 173. The motor 168 drives the chains 171 supported on two sending rollers 169 in the direction of the arrow A. In FIG. 7*b*, the same system is seen in a plan view from above and the scraping blades 179 collecting the scale are seen, scraping on the plates 177 of the channel 173. A collection tank 167 is noted around the inlet 176 provided with a channel 165 for collecting clarified overflow water. The collection tank 167 is located in the greater containment tank 162 (not shown, but visible in FIG. 7*a*). In the top view in FIG. 7*c*, a grid 182 for operator access can be noted. The bell-shaped inlet 176 is preferably fed by two closed pipes 176*a*. A door for accessing the interior for maintenance work is noted on the electrical panel 180. The front view of FIG. 7*d* clearly shows two closed pipes 176*a* for transporting the dirty water which open into the distribution hood 176.

Figure 8:
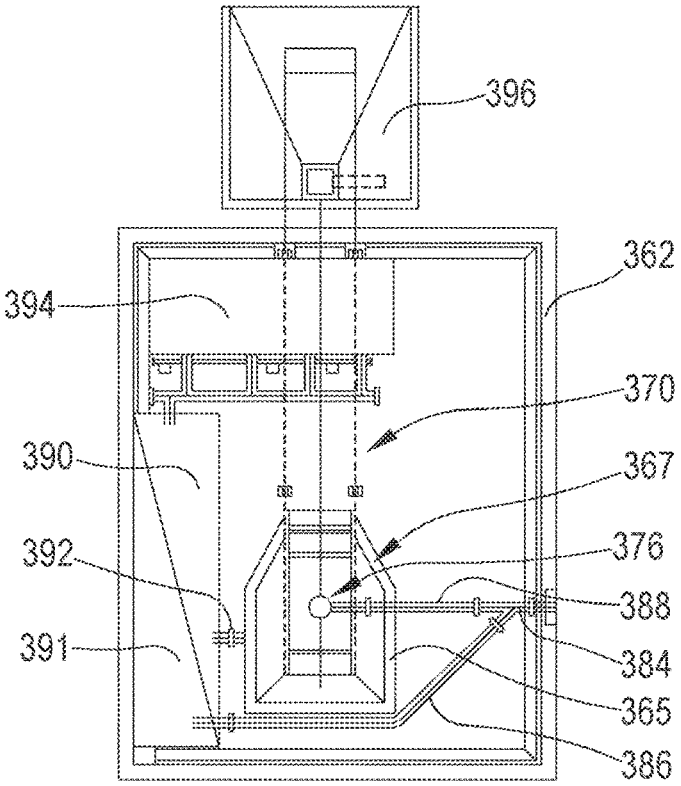
FIG. 8 depicts another example embodiment of the tank for collecting scale of medium-large size.

Lastly, FIG. 8 depicts in a plan view another example embodiment of the tank for collecting medium-large scale. A main containment tank 362 can be noted in which a smaller tank 367 is located for collecting the dirty water, in which there is a scraping conveyor 370 which transports the coarse scale in a special container 396. The tank 367 is provided with a drain channel with overflow 365 which can feed the laterally collocated clarified water tank 390 by means of the pipe 392. The dirty water arrives through a closed pipe 384 which is divided into a pipe 388 to feed the inlet 376 and a by-pass pipe 386 which feeds the tank 391 that serves, alternatively, as an emergency tank in case of the need for extraordinary maintenance of the automatic dredging system; from the emergency tank 391, where the scale with volume decants for some autonomous hours to allow the restoration of the dredge, the water reaches the clarified water tank 390 through an overflow. A pump station 394 serves to empty the tank 390 and to dedicate the removed water to different destinations (not shown).

The solution with two tanks with lower depth according to the invention allows to halve the necessary depth of the pits, to reduce the amount of reinforced concrete volume needed by over 1000-1500 $m^3$, to reduce the construction time of the civil works from about six months to about one month, a reduction in energy consumption, despite the need to have two pumping stations, even up to about 100 MW/year. The dredge is reliable and easy to maintain: typically every six months the scale transport cross-beams (flights) must be turned and complete maintenance must be carried out every year: changing the chains, flights and wear plates of the inclined bottom.

The costs for excavations and reinforced concrete works are also lowered by more than one million euros. The absolute volume of savings obviously depends on the size of the plants made. Furthermore, the system according to the invention unloads the coarse scale well separated from the water.

The invention claimed is:

1. A steel product processing plant, comprising at least one rolling mill provided with a plurality of stands arranged in series and suitable to progressively reduce the thickness of the product to be rolled in the advancement direction, and optionally a descaling machine and a continuous casting line arranged upstream of said rolling mill and of said descaling machine, wherein said plant is further provided with:

(a) at least one steel product direct cooling or cleaning system, or other system suitable to spray water on the product being processed;

(b) at least one system for separating mixtures, in particular mixtures of a muddy nature, comprising water and scale, deriving from said at least one steel product direct cooling or cleaning system, or from said other system suitable to spray water on the product being processed comprising:

(b-1) at least a first collection pit (F1) of the mixtures;

(b-2) at least a second collection pit (F2) of the mixtures;

wherein said pits (F1, F2) each have an overall depth <10 m, preferably <8 m, still more preferably <6.50 m; and wherein said at least a first collection pit (F1) is fed with mixtures deriving from the casting or from said descaling machine and/or from one or more of the initial stands of the rolling mill and wherein said at least a second collection pit (F2) is fed by one or more groups formed by the remaining stands of the rolling mill, wherein said first collection pit (F1) comprises:

(c) a dredging device, in particular a scraping conveyor.

2. The plant according to claim 1, wherein each pit (F1, F2) comprises:

(i) a channel or a channel system, (ii) at least one collection tank of the mixtures into which said channel or said channel system opens.

3. The plant according to claim 1, wherein said first pit (F1) comprises inclined walls, in particular with an inclination between 45 and 75.

4. The plant according to claim 2, wherein said channel or said channel system of said first pit (F1) comprises a distribution bell which forms the inlet in said at least one collection tank of the mixtures of said first pit (F1).

5. The plant according to claim 1, wherein said at least one collection tank of the mixtures of said first pit is provided in an upper edge along a perimeter, with one or more channel (s) of clarified water overflow which feed(s) at least one clarified water collection tank included for such a purpose in said first pit.

6. The plant according to claim 5, wherein said clarified water collection tank is arranged next to said at least one collection tank of the mixtures of said first pit.

7. The plant according to claim 1, wherein it further comprises an emergency tank, preferably at a side of said at least one collection tank of the mixtures of said first pit, and wherein the inlet to said at least one collection tank of the mixtures of said first pit is made as a closed pipe with an emergency by-pass adapted to feed said emergency tank.

8. The plant according to claim 1, wherein said pits (F1, F2) are at least partially arranged below said at least one steel product direct cooling or cleaning system, or other system suitable to spray water on the product being processed.

9. A process for separating mixtures comprising water and scale deriving from a direct cooling and/or descaling of steel products comprising the following steps:

(I) producing metal scale in an oxidation process of a steel product in continuous casting and/or rolling processes;

(II) water jet descaling and/or direct cooling of the continuous casting and/or rolling product resulting in scale accumulation in the descaling and/or direct cooling water forming said mixtures comprising water and scale;

(III) conveying the mixtures with large size scale, in at least a first pit (F1) with an overall depth of less than 10 m and preferably provided with a dredging device, such as a scraping conveyor, and removing the large size scale, in particular >500 μm, with said dredging device in a special container and diverting the clarified water, in particular by means of overflow elements present in said first pit (F1);

(IV) conveying the mixtures with scale of fine particle size, in particular ≤500 μm, into at least a second pit with a depth less than 10 m; and preferably removing the mixtures with pumps, without separation of the scale from the water, from the second pit.

10. A steel product processing plant, comprising at least one rolling mill provided with a plurality of stands arranged in series and suitable to progressively reduce the thickness of the product to be rolled in the advancement direction, and optionally a descaling machine and a continuous casting line arranged upstream of said rolling mill and of said descaling machine, wherein said plant is further provided with: (a) at least one steel product direct cooling or cleaning system, or other system suitable to spray water on the product being processed; (b) at least one system for separating mixtures, in particular mixtures of a muddy nature, comprising water and scale, deriving from said at least one steel product direct cooling or cleaning system, or from said other system suitable to spray water on the product being processed comprising: (b-1) at least a first collection pit (F1) of the mixtures; (b-2) at least a second collection pit (F2) of the mixtures; wherein said pits (F1, F2) each have an overall depth <10 m, preferably <8 m, still more preferably <6.50 m; wherein said at least a first collection pit (F1) is fed with mixtures deriving from the casting or from said descaling machine and/or from one or more of the initial stands of the rolling mill and wherein said at least a second collection pit (F2) is fed by one or more groups formed by the remaining stands of the rolling mill; and wherein said first pit (F1) comprises inclined walls, in particular with an inclination between 45 and 75 degrees.

* * * * *